US007806750B2

(12) United States Patent
Shaw

(10) Patent No.: US 7,806,750 B2
(45) Date of Patent: Oct. 5, 2010

(54) APPARATUS AND METHOD FOR CUTTING USING A LIQUID FLUID JET

(76) Inventor: Jack B. Shaw, 2710 Bedford St., Johnstown, PA (US) 15904

( * ) Notice: Subject to any disclaimer, the term of this patent is extended or adjusted under 35 U.S.C. 154(b) by 0 days.

(21) Appl. No.: 11/960,977

(22) Filed: Dec. 20, 2007

(65) Prior Publication Data

US 2008/0092703 A1 Apr. 24, 2008

Related U.S. Application Data

(60) Division of application No. 11/145,184, filed on Jun. 6, 2005, now abandoned, which is a continuation of application No. 10/183,630, filed on Jun. 28, 2002, now abandoned.

(60) Provisional application No. 60/301,124, filed on Jun. 28, 2001.

(51) Int. Cl.
*B24C 3/06* (2006.01)

(52) U.S. Cl. ..... 451/38; 83/745; 83/53; 30/300

(58) Field of Classification Search ..... 83/53, 83/177, 745; 30/300, 310; 451/38
See application file for complete search history.

(56) References Cited

U.S. PATENT DOCUMENTS

| | | | | |
|---|---|---|---|---|
| 1,823,218 | A * | 9/1931 | Swanson | 30/300 |
| 3,124,182 | A * | 3/1964 | Silken | 408/147 |
| 3,266,346 | A * | 8/1966 | Voissem | 408/68 |
| 4,137,804 | A | 2/1979 | Gerber et al. | |
| 4,378,959 | A | 4/1983 | Susnjara | |
| 4,380,138 | A | 4/1983 | Hofer | |
| 4,435,902 | A | 3/1984 | Mercer et al. | |
| 4,507,898 | A | 4/1985 | Hofer | |
| 4,603,515 | A | 8/1986 | Gilmore et al. | |
| 4,656,791 | A | 4/1987 | Herrington et al. | |
| 4,723,713 | A | 2/1988 | Dahlquist | |
| 4,827,679 | A | 5/1989 | Earle, III | |
| 4,966,059 | A | 10/1990 | Landeck | |
| 5,003,729 | A | 4/1991 | Sherby | |
| 5,018,418 | A | 5/1991 | Nasu | |
| 5,031,496 | A | 7/1991 | Lobash et al. | |
| 5,162,016 | A | 11/1992 | Malloy | |
| 5,372,540 | A | 12/1994 | Burch et al. | |
| 5,571,381 | A | 11/1996 | Vessari et al. | |
| 5,636,558 | A | 6/1997 | Sanders et al. | |
| 5,655,426 | A | 8/1997 | DeJohn | |
| 6,681,670 | B2 | 1/2004 | Caspar et al. | |
| 6,908,372 | B2 * | 6/2005 | Larsson | 451/75 |

FOREIGN PATENT DOCUMENTS

EP 0653271 * 5/1995

* cited by examiner

*Primary Examiner*—Kenneth E. Peterson
(74) *Attorney, Agent, or Firm*—Banner & Witcoff, Ltd.

(57) ABSTRACT

An apparatus and method for cutting a material using a water jet. A central shaft is mounted so as to extend outward from a material to be cut. A support member is mounted on the central shaft so as to extend transversely therefrom. At least one water jet cutting head is mounted on the support member so as to be translatable therealong. In addition, the at least one water jet cutting head is mounted so as to be rotatable about the central shaft. By controlling the translatory and rotational motion of the at least one water jet cutting head (for example, using computer numerical control or other computer control), a desired cut pattern can be followed with respect to the material being cut.

17 Claims, 3 Drawing Sheets

APPARATUS AND METHOD FOR CUTTING USING A LIQUID FLUID JET

RELATED APPLICATION

The present application is a divisional of U.S. application Ser. No. 11/145,184, filed Jun. 6, 2005, now abandoned, which is a continuation of U.S. application Ser. No. 10/183,630, filed Jun. 28, 2002, now abandoned, which claims the benefit and priority of Provisional U.S. application No. 60/301,124 filed on Jun. 28, 2001, now expired. The full disclosures of each of these applications are incorporated herein by reference.

FIELD OF THE INVENTION

The present invention relates to an apparatus and method for cutting a workpiece using a jet of fluid, such as water.

BACKGROUND OF THE INVENTION

It is conventionally known to use flame, oxy-fuel plasma, and other thermal torches to cut or cut into, for example, objects, structures, and solid materials in fields such as, for example, construction, manufacturing, mechanical repair, and salvage. However, the high temperatures generated can cause undesirable thermal distortions and other damage in the material being cut or cut into. Other undesirable by-products of using torches include health or life threatening noxious fumes, the generation of metal slag, and the risk of fire.

It is therefore generally known to use a high-pressure, small diameter water jet to cut or cut into, for example, objects, structures, and solid materials. However, cutting with conventional water jet systems can be inconvenient or limited in utility because it may, for example, be difficult or otherwise inconvenient to move a water jet head in a required manner to form a specific cut pattern. In this regard, many conventional water jet cutting systems are large, bulky, and fixed in location. In particular, many water jet cutting systems have a worktable form on which relatively small workpieces must be provided in a generally horizontal orientation on a cutting table. This makes it difficult or impossible to work in "on-site" situations, such as on a watercraft hull, for example, because the object being cut cannot be accommodated by the conventional water jet cutting system using a cutting table.

SUMMARY OF THE INVENTION

The present invention is therefore directed to an apparatus and method for performing water jet cutting that easily allows specific cut patterns to be formed in a workpiece, particularly, but not necessarily only, in hulls or other walls in a watercraft.

An apparatus according to the present invention includes a water jet cutting head rotatably positioned about a central shaft. The apparatus may optionally also include a corresponding water recovery catch also rotatably positioned about the central shaft, spaced apart from the water jet cutting head. The water jet cutting head and the water recovery catch are constructed and operated so as to move in substantial correspondence so that the water recovery catch is positioned to recover the water from water jet cutting head, regardless of the movement of the water jet cutting head.

The water jet cutting head may be constructed to move along and/or rotate and/or articulate about multiple spatial axes so that a desired cut pattern can be formed. The motion of the water jet cutting head (and the corresponding water recovery catch) may be controlled in any known manner, especially, but not exclusively, using a computer numerical control system used in connection with suitable mechanical driving devices, such as servomotors and the like. As a result, relatively complex, but easily repeatable cut patterns can be obtained. An additional benefit of using a computer control system is that the electronically stored data of the cutting path could be used to program a plate-cutting machine to produce a replacement piece in case the removed piece was damaged. Moreover, the water jet cutting system could be set-up in a repeatable manner across a ship class, thus providing the benefits and capabilities of an abrasive water jet cutting system that can make a cut pattern that can be repeated across the ship class. The ability to have repeatable equipment set-up would greatly improve the desirability of this type of equipment.

A method of cutting using a water jet according to the present invention generally includes mounting a central shaft with respect to a workpiece (especially, but not necessarily, a watercraft hull or wall) to be cut, mounting at least one water jet cutting head on one side of the workpiece to be cut so that the water jet cutting head is rotatable about the central shaft, supplying high pressure water to the water jet cutting head while moving the water jet cutting head as needed to form a desired cut pattern. The method according to the present invention may also include providing a water recovery catch mounted on the central shaft on the other side of the hull or wall to be cut and moving the water recovery catch in correspondence with the water jet cutting head.

The water jet cutting apparatus can, in a preferred embodiment, reliably operate in a vertical or near vertical position and provide access through a ship's hull and any associated composite material, painted components, insulation, wiring harnesses or other material. The water jet cutting system can provide the advantage of being able to, for example, cut through substrates of various thicknesses without distorting the material being cut, thus allowing the reuse of the cut material with reduced preparation. The cut pattern formed by the water jet cutting system has the additional advantage of having a small kerf and no heat affected zones or slag on the cut edge.

An apparatus, according to the present invention, can be easily transported for acting on a workpiece. The portability of the apparatus enables it, for example, to be stored at shipyard docks for use in cutting holes into ship hulls while at dockside or, in another example, to be stored on a vessel for use during repairs and refurbishment operations on the vessel.

BRIEF DESCRIPTION OF THE DRAWINGS

The present invention will be even more clearly understandable with reference to the drawings appended hereto, in which.

DETAILED DESCRIPTION

Figure 1:
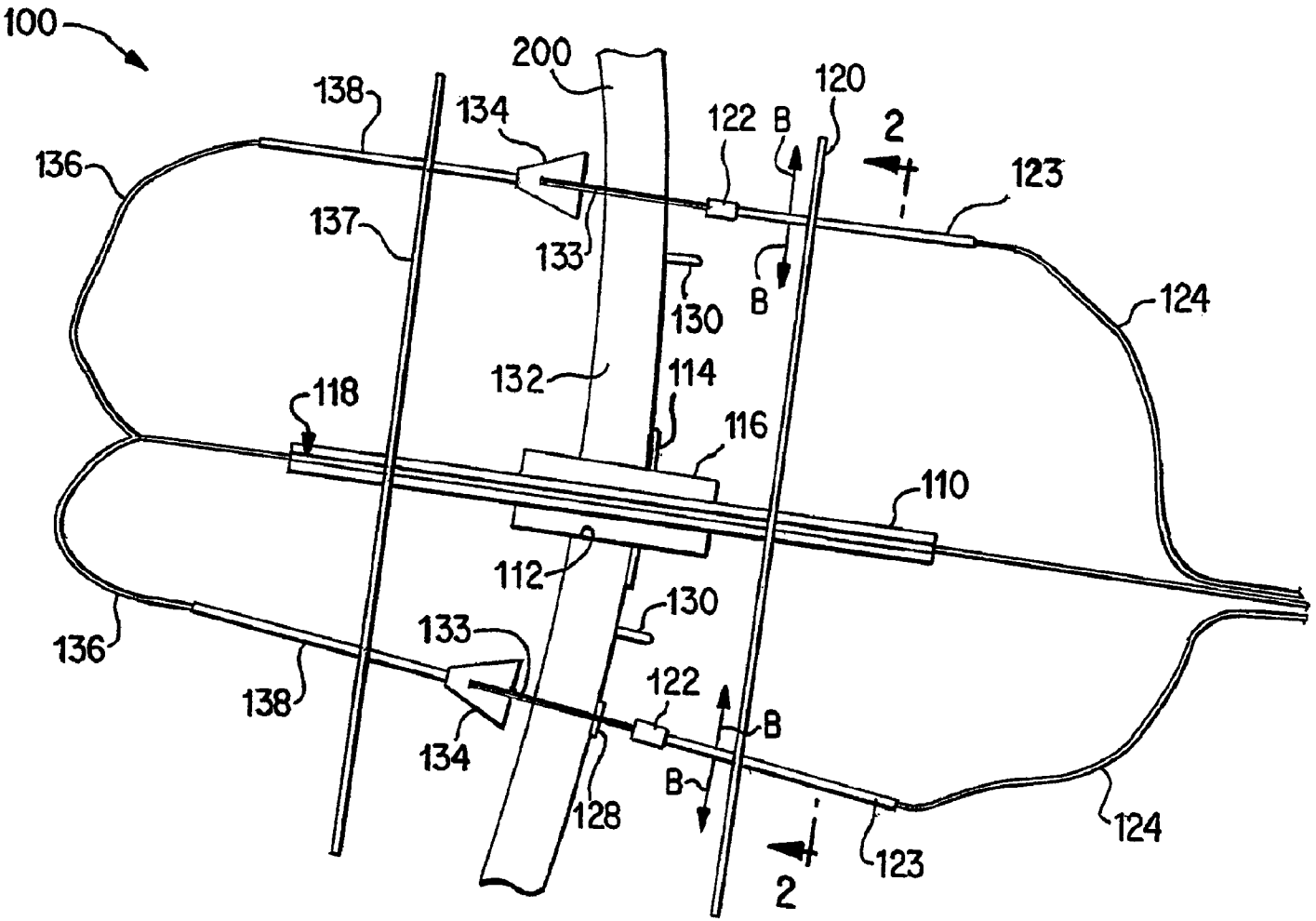
FIG. 1 is a side view of an embodiment of a water jet cutting apparatus according to the present invention.

FIG. 1 is a side view of a water jet cutting apparatus 100 according to the present invention. The apparatus 100 is positioned to cut an opening in a workpiece formed of a material, such as wall 200 as illustrated by way of example.

Apparatus 100 includes a central shaft 110 that is passed through a pilot hole 112 formed in wall 200. Central shaft 100, in a preferred embodiment, is a single, hollow unitary cylinder. In another embodiment, central shaft 100 can be a unitary shaft composed of a number of sections of different sizes. The pilot hole 112 can be formed either conventionally or through the use of a water jet technology. In a preferred embodiment, the diameter of pilot hole 112 is between about fifteen and twenty-four inches. However, other diameters can be used depending on the size of the apparatus 100 and the piece of material being removed. Central shaft 110 is fixed in position in pilot hole 112 in a known manner including, in an illustrative example, using one or more of a mounting plate 114 and/or a mounting collar 116 surrounding central shaft 110. In accordance with the present invention, the mounting plate 114 and mounting collar 116 may be independent parts or may be integrally formed.

Central shaft 110 is made from any suitably rigid material (in view of the spreader bar assembly/assemblies mounted thereon, as discussed below), including but not limited to steel or aluminum. Central shaft 110 has a bore 118 formed therethrough along its length, through which one or more water return lines may be passed, as discussed below.

On a first side of wall 200, at least one water jet cutting head 122 is mounted on a support member 120. The water jet cutting head 122 is conventional, such as a water jet cutting head available from the company Jet Edge in St. Michael, Minn. In turn, support member 120 is mounted on central shaft 110. As shown in the figures, the support member 120 is mounted on the central shaft 110 so that an angle is formed between the support member 120 and the central shaft 110. In one embodiment, this angle is substantially 90 degrees, as illustrated.

Figure 2:
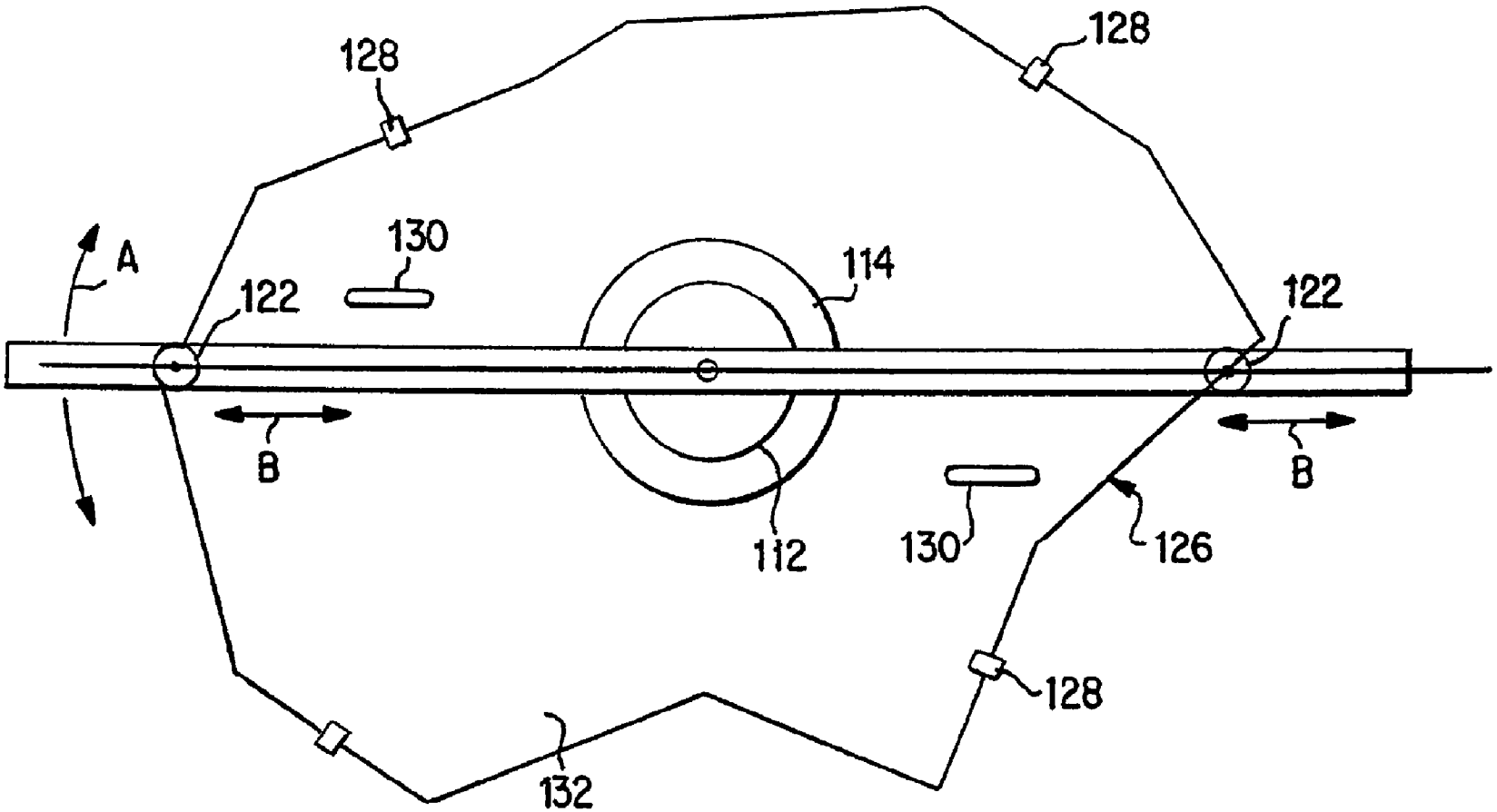
FIG. 2 is a view of the apparatus illustrated in FIG. 1, taken along line 2-2.

In accordance with the present invention, the at least one water jet cutting head 122 is positioned so that it rotates about central shaft 110 (as indicated by arrows A in FIG. 2). This can be realized in any known manner including, without limitation, fixedly mounting support member 120 relative to central shaft 110 and making central shaft 110 rotatably supported (for example, by bearings or the like in collar 116), or fixedly mounting central shaft 110 and rotatably mounting support member 120 about central shaft 110.

In an illustrative example of the present invention, support member 120 is a spreader bar, as such term is known in the art, along which the water jet cutting head 122 can move, as indicated by arrows B in FIGS. 1 and 2. The movement along the spreader bar may be effected in a known manner, such as using a powered ball-screw mechanism. In an alternative embodiment, the movement of the water jet cutting head(s) 122 between the ends of the support member 120 can be accomplished by using a rack and pinion mechanism.

Support member 120 may be a continuous member such that, for example, at least a portion of central shaft 110 is passed through support member 120 so that central shaft 110 can rotate thereabout (on bearings, for example). Alternatively, support member 120 may comprise one or more segments, wherein one end of a segment is fixed to central shaft 110 so that a respective segment extends radially outward from the central shaft 110.

Each water jet cutting head 122 may be mounted directly on support member 120, or indirectly, such as on a rigid subsupport 123, as illustrated in FIG. 1. A fluid feed 124 supplies high pressure fluid, such as water, to the water jet cutting head 122 from a conventional high pressure pump or the like (not shown here). The diameter of the fluid feed 124 is variable in a known manner according to the parameters of operation (including for example and without limitation, pressure, throughput, presence of abrasive particles entrained in the fluid, etc.).

Support member 120 can be driven to rotate in any conventional manner (depending on the manner in which support member 120 is mounted on central shaft 110), such as a motor or the like. Likewise, the translational motion of water jet cutting head 122 along support member 120 can also be effected in any known manner of translating a first object along a second member such as a rail (such as, without limitation, using a motor to drive a ball-screw mechanism or a rack and pinion mechanism). Accordingly, a detailed description of such details is omitted here, such operation being within the skill level of one of ordinary skill.

However, it is desirable according to the present invention to be able to control the motion of the water jet cutting head 122 both in rotation about central shaft 110 and in translation along support member 120. By controlling the motion of the at least one water jet cutting head 122, the position of the at least one water jet cutting head 122 relative to the central shaft 110 can be accurately achieved and maintained. This can be accomplished, for example, by using computer numerical control in accordance with known methods, such as computer control of the driving motors mentioned above by way of example. By simultaneously controlling the rotation of water jet cutting head 122 about central shaft 110 and the motion of water jet cutting head 122 along support member 120, a specific, predetermined cut pattern 126 (see FIG. 2) can be formed. As can be appreciated from cut pattern 126, relatively complex cut patterns can be formed including various combinations of straight segments and/or curved segments. It is expressly noted that cut pattern 126 is illustrative and not the only cut pattern that can be formed according to the present invention.

Thus, a process of cutting into a workpiece (especially, but not only, a wall or hull in a watercraft) includes cutting a pilot hole through the workpiece. The size of the pilot hole 112 is sufficient to pass central shaft 100 and mounting plate 114 and/or mounting collar 116 therethrough, but is relatively small compared to the area 132 defined by cut pattern 126. Pilot hole 112 may be formed in any conventional manner, including using conventional thermal cutting methods. Mounting plate 114 and/or mounting collar 116 may be fixed in place by any known method. However, it is desirable (but not necessary) to fix mounting plate 114 and/or mounting collar 116 in place using relatively easy-to-undo methods, such as bolts and the like, bearing in mind it is often desirable in practice to damage the cut area of material 132 defined by cut pattern 126 as little as possible. For example, it may be desirable to reposition the cut area of material 132 in the opening defined by cut pattern 126 after access through the opening is no longer needed. Therefore, if the cut area of material 132 is unduly damaged (such as from thermal distortion in the case of conventional thermal cutting), it is difficult to reposition it as needed.

Central shaft 110 is then mounted with respect to mounting plate 114 and/or mounting collar 116. As mentioned above, central shaft 110 may have a bore 118 formed therethrough. If a water recovery system is used (as discussed further below), the bore 118 may itself serve as a return line, or it may serve as a conduit through which return lines are passed.

Support member 120 is mounted on central shaft 110 in a known manner dependent on whether support member 120 is to be rotatable about central shaft 110 or whether central shaft 110 is itself rotated in a known manner. In any event, support member 120 is rotatable about central shaft 110 by any known means, especially, but not only, one or more motors in, for example, geared engagement with the central shaft 110 and/or support member 120. In addition, at least one water jet cutting head 122 is mounted on support member 120 in accordance with the foregoing. In some cases, it may be desirable to provide more than one water jet cutting head, such as providing two water jet cutting heads 122 adjacent to opposite ends of support member 120. Using multiple water jet cutting heads 122 may, for example, reduce the amount of time needed to form a predetermined cut pattern. 126. For example, one portion of the cut pattern 126 can be formed by one water jet cutting head 122, and another portion of the cut pattern 126 can be formed by another water jet cutting head 122.

High-pressure water 133 is supplied to water jet cutting head 122 in a known manner via supply lines 124. The water used may include abrasive particles entrained therein. These particles are entrained in the water as the water passes through a mixing chamber (not shown). The entrained abrasive particles can facilitate the cutting process. One example of such abrasive particles is garnet particles. Upon exit from water jet cutting head 122, the water (and any entrained particles) may be at, for example, 55,000 psi and traveling at Mach 3.

It is noted that water is discussed herein strictly by way of example, and that other liquids may be usable in accordance with the present invention.

Cut pattern 126 may be defined in one of several ways. In one illustrative example according to the present invention, a particular cut pattern may be predefined by computer-implemented methods (such as CAD/CAM). That electronic definition may then be provided to one or more controllers controlling the action of one or more motors (not shown) driving the rotation of support member 120 and the translational motion of water jet cutting head(s) 122 along support member 120, using known computer numerical control methods.

In another example according to the present invention, the motor controller(s) may be manually pre-programmed, using known methods, to follow cut pattern 126.

In yet another example according to the present invention, the water jet cutting head(s) 122 may be constructed to sense a "path" marked on the surface to be cut. For example, a cut pattern 126 may be painted on the surface to be cut using a slightly radioactive (i.e., well below hazardous levels) paint or the like, and water jet cutting head(s) 122 may include detectors for sensing the radioactivity of the paint and controlling the water jet cutting head(s) 122 to follow the paint path so that predetermined cut pattern 126 is accurately formed.

The area defined by predetermined cut pattern 126 may, for example, be as large as 20 feet across at a widest point. In order to prevent the cut area of material 132 from shifting before cutting is completed, it may be useful, but not always necessary, to provide temporary supports 128 at intervals along cut pattern 126 to keep the cut area of material 132 positionally stable. Likewise, it may be useful, but not always necessary, to provide temporary lifting lugs 130 at one or more locations on the cut area of material 132 to facilitate handling (i.e., removing and/or repositioning) of the cut area of material 132.

Figure 3:
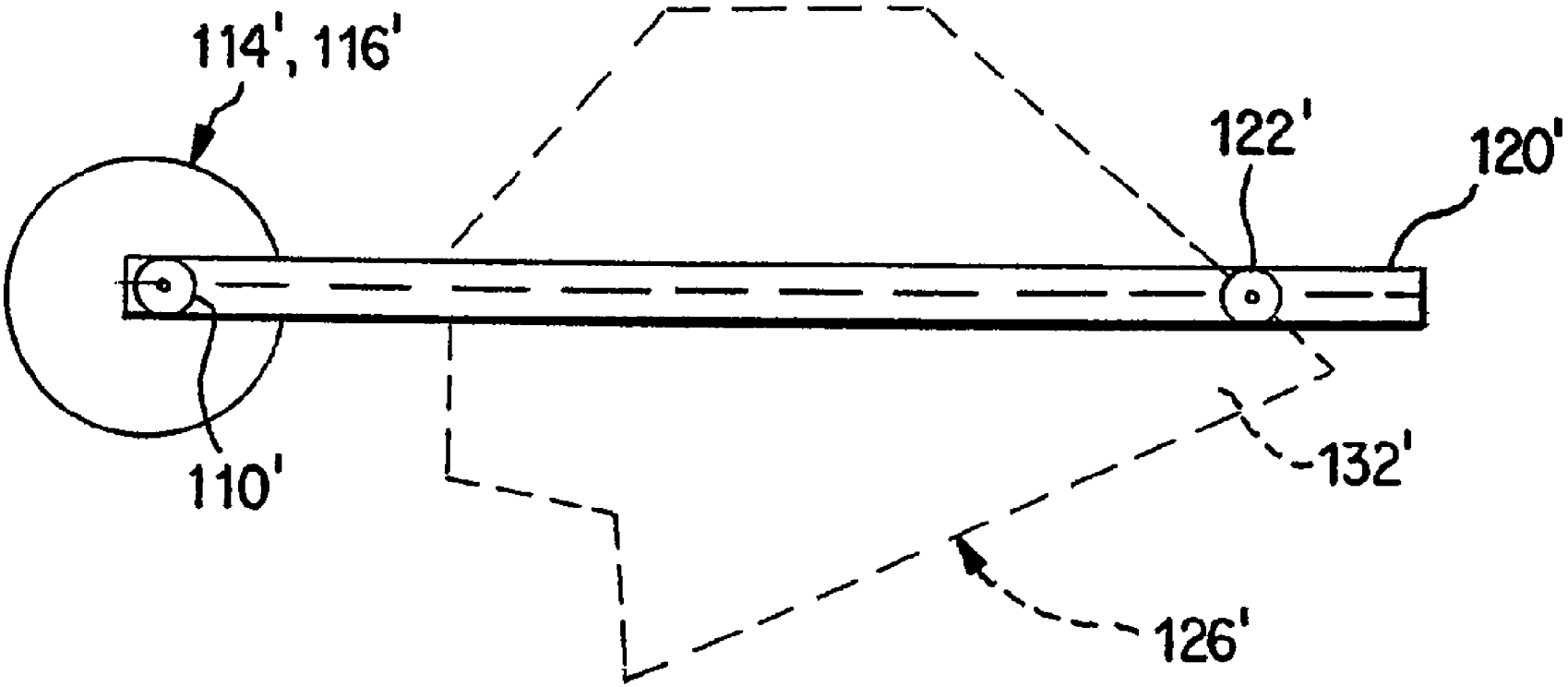
FIG. 3 is a plan view of another embodiment of an apparatus according to the present invention.

FIG. 3 is a plan view of another embodiment of the present invention. Instead of rotatably mounting a support member 120 at a central portion thereof, as in FIGS. 1 and 2, support member 120' in the second embodiment is rotatably mounted adjacent to one end thereof, so as to rotatable about a central shaft 110'. Central shaft 110' is mounted in accordance with the foregoing description of central shaft 110 using a mounting plate 114' and/or mounting collar 116'. Support member 120' has a water jet cutting head 122' mounted thereon in accordance with the foregoing description of water jet cutting head 122, and is movable along support member 120' in a manner similar to that described above with respect to the first embodiment.

As can be appreciated from FIG. 3, a difference between the first and second embodiments of the present invention is that support member 120' is rotatably mounted outside of the area defined by cut pattern 126'. Thus, in practice, support member 120' sweeps out a sector while water jet cutting head 122' translates therealong to trace out cut pattern 126'. In any of the above discussed embodiments using one or an odd number of water jet cutting head(s) 122 (122), a counter weight can be positioned on the support member 120 (120') opposite the water jet cutting head 122 (122).

Generally, water jet cutting head 122(122') is positioned so that the water jet therefrom is perpendicularly incident on a material being cut. Accordingly, it may be desirable to let water jet cutting head 122(122') articulate so that the water jet therefrom can be maintained in a perpendicular relationship to the material being cut, especially when the topography of the material being cut is curved or otherwise variable (such as the curved hull of a watercraft). Also, it may be useful to make an oblique cut along a cut pattern 126(126). For example, such an oblique cut may facilitate repositioning the cut area of material 132(132) when needed.

It may also be useful to vary the fore-aft (i.e., along the axis of central shaft 110(110') position of water jet cutting head 122(122') in order to maintain an optimal spacing between the water jet cutting head and the material being cut, again especially when the topography of the material being cut is curved.

In general, it is useful according to the present invention to provide some form of energy-dissipating barrier on the other side of material being cut (such as wall 200) because the water jet from water jet cutting head 122(122') still may have significant kinetic energy after cutting into a workpiece. In some cases, therefore, it may be sufficient to provide an angled back plate (not shown) made of a suitably strong material. The water jet striking the back plate at an oblique angle dissipates the energy of the water jet, and the waste water may, for example, be allowed to drain as waste.

In another arrangement, as seen in FIG. 1 by way of example, a water recovery catch 134 may be mounted on central shaft 110 by way of support arm 137 in a manner identical to water jet cutting head 122 (122'), so that the water recovery catch 134 is always located in substantial correspondence with water jet cutting head 122 (122'). Therefore, by providing electronic control signals from a computer to the motor(s) controlling water jet cutting head 122 (122') and water recovery catch 134 that causes identical mirrored motion of the water jet cutting head 122(122') and water recovery catch 134, the two elements may be made to move in unison so that each water recovery catch 134 is positioned to receive the water jet from a respective water jet cutting head 122(122'). Thus, water recovery catch 134 can recover the water from water jet cutting head 122(122') and absorb the energy from the spray of the water jet. In one embodiment, rotation of the hollow shaft rotates the two supports 120 and 137.

Water recovery catch 134 is, in an illustrative example, a frustoconical member having an open major end located to receive the water jet from water jet cutting head 122, as seen in FIG. 1. The oblique walls of water recovery catch 134 usefully act in a manner similar to the back plate described above, and serve to decelerate and deenergize the water jet from water jet cutting head 122. In an embodiment, the water recovery catch 134 can include carbide or ceramic inserts to absorb the energy from the water jet and diffuse the water jet.

Water recovery catch 134 is connected to a conventional fluid line 136. As mentioned above, fluid line 136 may be routed through central shaft 110. If necessary, a vacuum draw may be applied to fluid line 136 in a conventional manner to move water therealong. In one embodiment, a suction system (not shown) is mounted on the interior of spreader bar 137 immediately behind the water recovery catch 134. The recovered water may be either discarded as waste, or may be filtered if needed (so as to remove any metal fragments or abrasive particles entrained therein) and recycled.

If desired, a subsupport 138 may be provided intermediate water recovery catch 134 and fluid line 136, in a manner similar to subsupport 123, discussed above.

Thus, while there have been shown and described and pointed out fundamental novel features of the present invention as applied to preferred embodiments thereof, it will be understood that various omissions and substitutions and changes in the form and details of the devices illustrated, and in their operation, and in the method illustrated and described, may be made by those skilled in the art without departing from the spirit of the invention as broadly disclosed herein.

The invention claimed is:

1. A method of cutting a wall in the hull of a ship comprising:

mounting a water jet cutting head on a support member;

attaching said support member to said wall;

providing a hollow shaft extending outward from said wall;

securing the support member to the shaft, said support member extending at an angle to said shaft;

wherein the water jet cutting head is rotatable about said shaft; and movable along the length of the support member providing translatable motion of said water jet cutting head relative to said wall;

cutting the wall by supplying water to the water jet cutting head while controlling the translatory movement to follow a non-circular pattern on the wall;

removing a section of the wall defined by the pattern;

wherein the water supplied to the water jet cutting head is collected on the side of the hull opposite the mounting and returned through the hollow shaft.

2. The method of claim 1 wherein at least two water jet cutting heads are mounted on said support.

3. The method of claim 1 wherein the pattern surrounds said support.

4. The method of claim 1 wherein the pattern is off set from said support.

5. The method of claim 1 wherein the translatory movement is controlled by a controller.

6. The method of claim 1 wherein the water supplied to the water jet cutting head contains abrasive.

7. The method of claim 1 wherein the water jet cutting head is movable along the length of the support member by a rail.

8. The method of claim 1 wherein the controlling is accomplished by tracing the pattern on the wall and then controlling the translatory movement of the water jet cutting head to follow the pattern on the wall.

9. The method of claim 8 further comprising tracing the pattern with radioactive paint.

10. The method of claim 1 further comprising controlling the water jet cutting heads to cut an oblique pattern.

11. The method of claim 1 wherein the water supplied to the water jet cutting head is collected on the side of the hull opposite the mounting.

12. The method of claim 1 further comprising cutting a pilot hole in said wall and extending the shaft though said pilot hole.

13. The method of claim 12 further comprising fixing the shaft in position in said pilot hole.

14. A method of cutting a wall in the hull of a ship comprising:

cutting a pilot hole in said wall;

providing a hollow shaft though said pilot hole and extending from said wall;

mounting a water jet cutting head on a support member;

attaching said support member to said shaft;

rotating said water jet cutting head about said shaft and moving the water jet cutting head along the length of the support member providing translatable motion of said water jet cutting head relative to said wall;

cutting a section of the wall by supplying water to the water jet cutting head while controlling the translatory movement;

removing a section of the wall;

wherein the water supplied to the water jet cutting head is collected on the side of the hull opposite the mounting and returned through the hollow shaft.

15. The method of claim 14 wherein the controlling is accomplished by tracing a pattern on the wall and then controlling the translatory movement of the water jet cutting head to follow the pattern on the wall.

16. The method of claim 14 wherein the translatory movement is controlled by a controller.

17. The method of claim 14 wherein the water jet cutting head is movable along the length of the support member by a rail.

* * * * *